US005499726A

United States Patent [19]

Mitchell

[11] Patent Number: 5,499,726

[45] Date of Patent: Mar. 19, 1996

[54] MULTIPLE-HEIGHT MODULAR DISPLAY PEDESTAL FOR DISPLAYING MERCHANDISE

[76] Inventor: Patrick J. Mitchell, 333 - 112th Ave. SE., Bellevue, Wash. 98004

[21] Appl. No.: 222,898

[22] Filed: Apr. 5, 1994

[51] Int. Cl.[6] ..... A47F 5/00

[52] U.S. Cl. ..... 211/183; 211/13; 211/188; 211/194; 211/196; 211/204; 229/4.5; 229/101; 248/159; 248/174

[58] Field of Search ..... 211/183, 13, 194, 211/204, 196, 188; 229/4.5, 101; 248/159, 174; 52/730.4, 730.5, 731.3, 732.2, 721.4, 721.5, 723.1, 723.2, 724.5, 738.1, 740.4

[56] References Cited

U.S. PATENT DOCUMENTS

| | | | |
|---|---|---|---|
| 739,600 | 9/1903 | Heinig | 138/166 |
| 1,460,021 | 6/1923 | Hildebrand | 138/166 |
| 1,983,989 | 12/1934 | Pallas | 138/166 |
| 2,089,084 | 8/1937 | Arneson . | |
| 2,214,480 | 9/1940 | Schecter | 138/166 |
| 2,634,761 | 4/1953 | Gray | 138/166 |
| 2,957,601 | 10/1960 | Novick . | |
| 3,768,637 | 10/1973 | Whang | 211/194 X |
| 3,927,625 | 12/1975 | Lang | 211/194 X |
| 4,179,033 | 12/1979 | Mitchell | 211/60 |
| 4,415,077 | 11/1983 | Murphy | 211/194 X |

*Primary Examiner*—Leslie A. Braun
*Assistant Examiner*—Brian J. Hamilla
*Attorney, Agent, or Firm*—Seed and Berry

[57] ABSTRACT

An adjustable height pedestal is formed of one, two, or more identical or variant height pleated upright members. The pleated upright members are interconnected by two or more connector rings at either end of each pleated upright member. When two or more pleated upright members are used to form one display pedestal, one connector ring interconnects the area between two of said pleated upright members. A disc rests upon four lid/base supports inside the topmost connector ring, and is covered by a lid which interconnects with said connector ring. A second identical disc rests on the four lid/base supports inside the bottom-most connector ring. Display pedestals over 12" in height are generally stabilized with a heavy block which is readily accessible and which sits on top of the disc in the bottom of the display. In one embodiment the lid and disc are not used leaving an open display pedestal for cylindrical merchandise.

16 Claims, 2 Drawing Sheets

MULTIPLE-HEIGHT MODULAR DISPLAY PEDESTAL FOR DISPLAYING MERCHANDISE

TECHNICAL FIELD

This invention pertains to display pedestals for general merchandise, i.e., shoes, jewelry, lamps, flowers, etc., where it is desirable to display the merchandise for a store, showroom or window display. This invention also pertains to display pedestals for seasonal merchandising where it is desirable to remove the display pedestals and knock down flat for compact storage when not in use.

BACKGROUND OF THE INVENTION

Merchandise has generally been displayed on tables, wooden stands, etc., of fixed heights. Heretofore, an easily assembled multiple-height round display pedestal has not been available. In general, standard merchandising display pedestals or stands have been made only in various fixed heights.

SUMMARY OF THE INVENTION

It is an object of this invention to provide an inexpensive multiple-height display pedestal, the components of which are modular units so that the components can be mass produced to provide an inexpensive but attractive display pedestal.

It is another object of this invention to provide a display pedestal which can be easily rearranged for various displaying height and space requirements.

It is another object of this invention to provide a display pedestal which will easily assemble and disassemble, and which will knock down flat for compact storage when not in use.

It is another object of this invention to provide a display pedestal which is lightweight for easy and economical shipping of same.

Basically these objects are obtained by providing pleated upright members which form tubular means and interconnect with circular connector rings at their openings. A support in the form of a disc is placed at the base of a pleated upright member and held in place between the pleats on the pleated upright on four lid/base supports inside the connector ring. A second identical disc rests inside the topmost connector ring on top of the four lid/base supports and is covered with a lid which interconnects with the topmost connector ring, holding the heavy disc in place. Display pedestals over 12" in height are generally stabilized with a heavy block which is readily accessible and which sits on top of the disc in the bottom of the display pedestal. Optionally, four feet may be interconnected with the connector ring at the bottom of the display pedestal to provide additional support.

In the embodiment where two or more pleated upright members are connected together, the abutting ends are interconnected to common connector rings so that one multi-height display pedestal is formed.

DETAILED DESCRIPTION OF THE INVENTION

Figure 1:
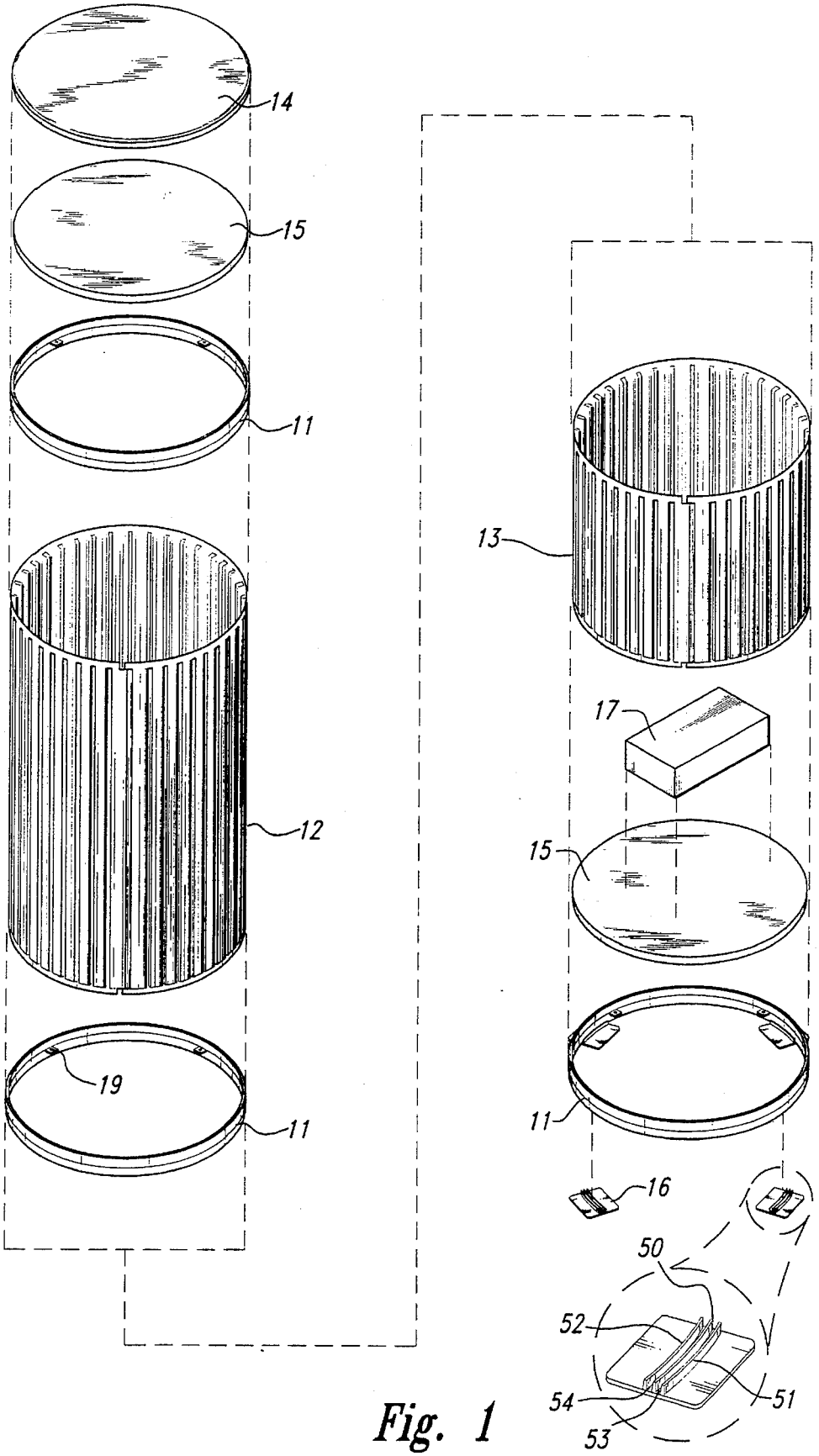
FIG. 1 is an exploded isometric of combined short and long modular pleated upright members.

As best illustrated in FIG. 1, a modular single or multi-height display pedestal is formed of identical connector rings 11, pleated long and short upright members 12 and 13, respectively, discs 15 of a wood or other solid material, a lid 14, optional feet 16 and an optional heavy block 17 for particularly tall display pedestals.

The term "modular" as used herein means that the members are each identical to the same type of members. Both the heavy block 17 and feet 16 may be optional and only used where additional stability for the display pedestal is needed.

Figure 7:
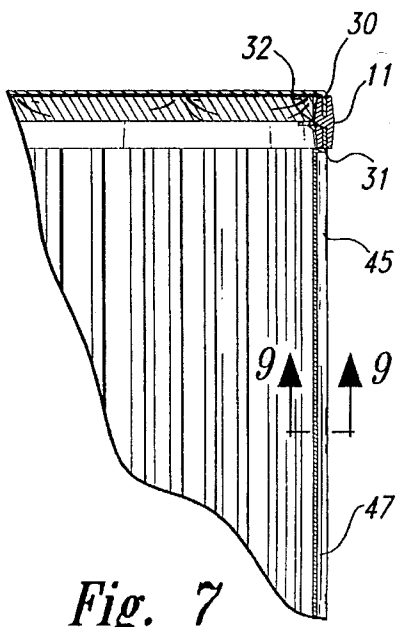
FIG. 7 is a fragmentary vertical section taken along the line 7—7 of FIG. 6 of an upper corner of a typical display pedestal.
Figure 6:
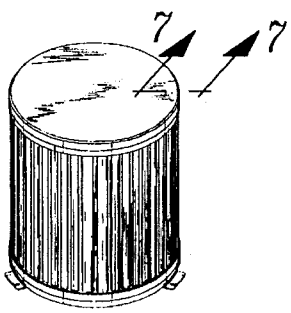
FIG. 6 is an isometric of a short display pedestal.
Figure 5:
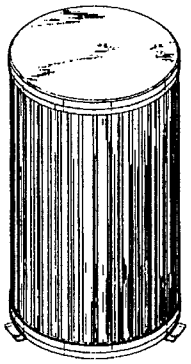
FIG. 5 is an isometric of a long display pedestal.
Figure 4:
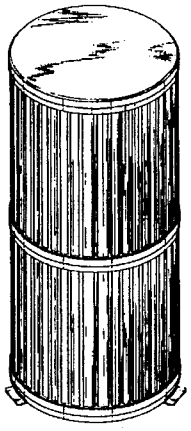
FIG. 4 is an isometric of two short combined display pleated upright members.

As illustrated in FIG. 7, each connector ring 11 includes a pair of central grooves 30 and 31 at the top and bottom, respectively, running the circumference of the ring. The grooves join at a central web 32 around the circumference creating an "H"-shaped cut-away, which holds the pleated upright members 12, 13, the lid 14, and the optional feet 16.

As illustrated in FIG. 1, each connector ring 11 is further provided with four equidistantly spaced tabs or lid/base supports 19 centered on the inside circumference of said connector ring, which are utilized in holding in place discs 15.

Figure 8:
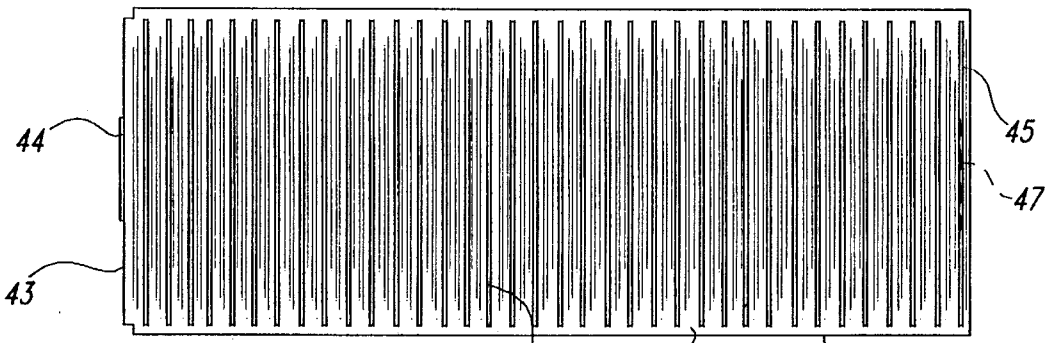
FIG. 8 is a plan view of a typical pleated upright member laid out flat for shipping or storage.
Figure 9:
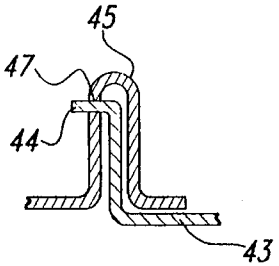
FIG. 9 is a fragmentary horizontal section taken along the line 9—9 of FIG. 7.

As best shown in FIGS. 7, 8, and 9, the upright members 12 and 13 are formed from a flat sheet 40 having corrugations 41 equidistantly spaced along the sheet and running approximately the entire top to bottom of the sheet. An end 43 of one half of a corrugation has a tongue 44 protruding out from the end. A locking corrugation 45 has a central slot 47 that receives the tab when the sheet is formed into a cylinder to form a pedestal. When the tongue is placed in the slot the end 43 nests within the locking corrugation 45 to provide a full abutment along the length of the end and locking corrugation.

As a sturdy base will always be necessary on any display pedestal, if desired, a permanent base may be created by gluing the bottom connector ring to the pleated upright member at the base of the display pedestal with the disc in between said connector ring and said pleated upright member.

Figure 3:
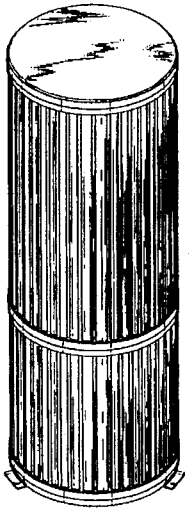
FIG. 3 is an isometric of long and short combined display pleated upright members.
Figure 2:
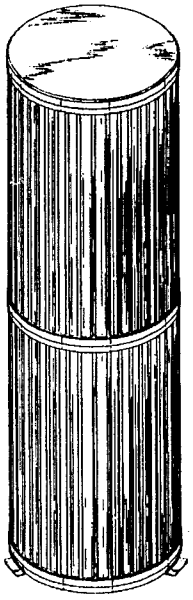
FIG. 2 is an isometric of two combined long display pleated upright members.

FIGS. 2–6 show variations of display pedestals. To construct a typical pedestal, for example, a combination long and short display pedestal as shown in FIGS. 1 and 3, the two sheets 40 are rolled and locked into cylinders to form upright members as at 12 and 13. Then, a connecting ring is fitted onto the bottom edge of the long upright member with the edge of the upright member fitting into slot 30 of the connecting ring 11. The top edge of the short upright member 13 is fitted into the slot 31 of the same connecting ring to lock the two upright members together. Another upper connecting ring is fitted onto the top edge of the long upright member 12, a disc 15 placed in the ring and onto the tabs or supports 19, and a lid 14 is fitted into the top groove 30 of the upper connecting ring. A disc 15 is fitted into a lower connecting ring onto supports 19 and the lower edge of the short upright member is fitted into the upper groove 30 of the lower connecting ring. If desired, the block 17 can be placed on the disc before connecting the lower connecting ring to the short display pedestal. Also, if desired, feet 16 can be pushed over the lower edge of the lower connecting ring as shown in FIG. 1.

The feet 16 have a central flange 50 and end flanges 51 and 52 spaced from the central flange to form grooves 53 and 54. The central flange fits into the connecting ring groove 31 with the spaced walls forming the ring around the groove 31 fitting into the grooves 53 and 54 of the foot.

FIGS. 2–6 show the various combinations of display pedestals that can be formed using the technique just described.

As shown also in the exploded view of FIG. 1, by not adding an upper disk and a lid, the pedestal can remain open allowing its use for storing cylindrical merchandise such as rolled posters, wallpaper, umbrellas, or canes.

While the preferred embodiments of the invention have been illustrated and described, it should be understood that variations will be apparent to one skilled in the art without departing from the principles herein. Accordingly, the invention is not limited to the specific embodiments illustrated.

I claim:

1. A display pedestal for showing merchandise in a store, showroom, or window display, comprising:

lightweight upper and lower connector rings which are ring-shaped with a plurality of radially inwardly extending supports integrally fixed inside to each connector ring for holding a disc or other support means and said rings each having upper and lower substantially U-shaped grooves;

vertical circular tube means pleated with spaced corrugations and having end edges for fitting in one of said connector ring upper and lower grooves so as to form a vertical display pedestal; and discs or other support means which rest upon the supports in the upper and lower connector rings so as to provide stability, and a lid at the top of said display pedestal to form a solid top surface wherein said lid is seated in an upper groove of the connector ring.

2. The display pedestal of claim 1, said pleated upright members and said lids having a diameter approximately equal to the center diameter of said connector rings so that the pleated upright members and lids are held tightly within the connector ring, said discs or other support means having a diameter slightly smaller than the inside of the connector rings and pleated upright members whereby the discs or other support means may rest upon said supports.

3. The display pedestal of claim 1, including a solid disc supported in said upper connecting ring and a lid having a downwardly extending flange fitted into the other of said central grooves of said upper connecting ring.

4. A display pedestal for showing merchandise in a store, showroom, or window display, comprising:

lightweight upper and lower connector rings which are ring-shaped with a plurality of radially inwardly extending supports inside each connector ring and having upper and lower substantially U-shaped grooves;

vertical circular tube means pleated with spaced corrugations and having end edges for fitting in one of said connector ring upper and lower grooves so as to form a vertical display pedestal;

discs which rest upon the supports in the upper and lower connector rings so as to provide stability, a lid at the top of said display pedestal to form a solid top surface, the lid seated in an upper groove of the upper connector ring; and separate, independent feet of which four may be utilized optionally to provide additional stability to a display pedestal, and which interconnect with the lower connector ring.

5. The display pedestal of claim 4, including a heavy block which rests on said disc in said lower connecting ring.

6. The display pedestal of claim 5, said lid, top disc and heavy block being removed to be utilized in a vertical position for displaying of long or cylindrical merchandise such as posters, wallpaper rolls, umbrellas, or canes.

7. The display pedestal of claim 4, said pleated upright members and said lids having a diameter approximately equal to the center diameter of said connector rings so that the pleated upright members and lids are held tightly within the connector ring, said discs having a diameter slightly smaller than the inside of the connector rings and pleated upright members whereby the discs may rest upon said supports, and said feet being of the same thickness as the groove in the center of the connector rings so that the feet fit firmly inside the connector ring.

8. A knock-down easily assembled display pedestal comprising at least one upright pleated member formed from a flat sheet having opposite ends and having a plurality of equidistantly spaced elongated corrugations extending between upper and lower opposite edges, the sheet being rolled into a cylinder shape having a periphery with abutting ends interlocked, thereby forming a non-corrugated circular edge portion at each of said opposite edges of said cylinder shape, said corrugations formed with spaced parallel side walls generally perpendicular to the periphery of the cylinder shape and terminating at closed ends, said sheet having a locking tongue protruding from one end of the sheet, the opposite end of the sheet having one of said corrugations provided with a slot, said slot being located in the corrugation side wall, and wherein the sheet ends are interlocked by inserting the locking tongue into the corrugation between the spaced side walls and thence into the slot, an upper connecting ring having opposed central grooves, one of said grooves fitted over said non-corrugated edge portion of the sheet, and a lower connecting ring having opposed central grooves, one of said grooves fitted over the opposite non-corrugated edge portion of the sheet.

9. The display pedestal of claim 8, including a second upright pleated member formed from a flat sheet having opposite ends and having a plurality of equidistantly spaced elongated corrugations extending between opposite upper and lower edges, the sheet being rolled into a cylindrical shape with abutting ends interlocked, one edge of said second upright pleated member fitted into the opposite central groove of said lower connecting ring to form a multiple pleated member display pedestal.

10. The display pedestal of claim 9, wherein the pleated members are of different lengths.

11. The display pedestal of claim 8, including a lower disc supported on said lower connecting ring.

12. A knock-down easily assembled display pedestal comprising at least one upright pleated member formed from a flat sheet having opposite ends and having a plurality of equidistantly spaced elongated corrugations extending between upper and lower opposite edges, the sheet being rolled into a cylinder shape with abutting ends interlocked, an upper connecting ring having opposed substantially U-shaped central grooves, one of said grooves fitted over the edge of the sheet, and a lower connecting ring having opposed substantially U-shaped central grooves, one of said grooves fitted over the opposite edge of the sheet, comprising:

a lower disc supported on said lower connecting ring, and a heavy block on said lower disc, and feet fitted into the opposite central groove of said lower connecting ring.

13. A display pedestal for showing merchandise in a store, showroom, or window display, comprising:

lightweight upper and lower unitary connector rings which are ring-shaped and having upper and lower substantially U-shaped grooves, each ring being a one-piece integral structure;

vertical circular tube means pleated with spaced corrugations and having upper and lower end edges for fitting in one of said connector ring upper and lower grooves so as to form a vertical display pedestal, the upper end edge of said tube means being seated in the lower groove of the upper unitary connector ring, the lower end edge of said tube means being seated in the upper groove of the lower unitary connector ring; and a lid at the top of said display pedestal to form solid top surface.

14. The display pedestal of claim 13, including a second tube means having upper and lower end edges, the upper end edges of said second tube means being seated into the lower groove of the lower unitary connector ring.

15. The display panel of claim 13, said lid seated into the upper groove of the upper unitary connector ring.

16. The display pedestal of claim 13, wherein said lid is supported by a plurality of radially inwardly extending supports attached to said upper connector ring.

* * * * *